US006736070B2

(12) United States Patent
Baltos

(10) Patent No.: US 6,736,070 B2
(45) Date of Patent: May 18, 2004

(54) PASSIVE ACTION SECURITY SYSTEMS

(76) Inventor: Joseph C. Baltos, 14201 Harrowgate Rd., Chester, VA (US) 23831

( * ) Notice: Subject to any disclaimer, the term of this patent is extended or adjusted under 35 U.S.C. 154(b) by 0 days.

(21) Appl. No.: 10/368,401

(22) Filed: Feb. 20, 2003

(65) Prior Publication Data

US 2003/0167955 A1 Sep. 11, 2003

Related U.S. Application Data

(60) Provisional application No. 60/362,472, filed on Mar. 6, 2002.

(51) Int. Cl.[7] ..... F42B 12/54

(52) U.S. Cl. ..... 102/512; 102/444; 102/447; 102/513

(58) Field of Search ..... 102/512, 444, 102/447, 502, 513; 604/130

(56) References Cited

U.S. PATENT DOCUMENTS

| | | | | |
|---|---|---|---|---|
| 1,651,349 A | | 11/1927 | Gaertner | |
| 1,815,300 A | | 7/1931 | Harris | 102/512 |
| 2,018,191 A | | 10/1935 | Schmidt | |
| 2,617,359 A | | 11/1952 | Van Horn et al. | 102/512 |
| 3,386,381 A | | 6/1968 | Ferb | 102/512 |
| 3,502,025 A | | 3/1970 | Payne | 102/512 |
| 3,584,852 A | | 6/1971 | Muller | 102/512 |
| 3,754,509 A | | 8/1973 | Gogen | 102/512 |
| 3,820,465 A | | 6/1974 | Delphia | 102/512 |
| 3,837,284 A | | 9/1974 | Waldeisen | 102/512 |
| 3,901,158 A | | 8/1975 | Ferb | 102/517 |
| 4,091,736 A | * | 5/1978 | Mizelle | 102/502 |
| 4,598,096 A | | 7/1986 | Grant | 514/715 |
| 5,698,815 A | | 12/1997 | Ragner | 102/502 |

FOREIGN PATENT DOCUMENTS

| | | | | |
|---|---|---|---|---|
| GB | 2081427 | * | 2/1982 | 102/447 |

* cited by examiner

*Primary Examiner*—Harold J. Tudor
(74) *Attorney, Agent, or Firm*—McGuireWoods LLP

(57) ABSTRACT

A specialty bullet is disclosed that is adapted to transmit a tranquilizing fluid upon impact with a target for purposes of immobilizing the intended target without causing great harm to the target or the surrounding area. The specialty bullet is sized and shaped like that of a conventional bullet so that it can be fired from a conventional firearm; however, the concept could work with innumerable types of ammunition. The disclosed invention includes a so-called "Collapsule" bullet, which is a molded, hollow cavity fabricated of a high-strength malleable plastic polymer that is filled with a tranquilizing fluid. The bullet is fitted with a so-called "Injectile," which is a hypodermic injection spike (to transmit the tranquilizing fluid) that is backed and driven by an inertia base mass (i.e., lead core or other suitable) located at the base of the bullet. The disclosed invention provides law enforcement officials with a non-lethal (or less lethal) deterrent to life-threatening situations, including aircraft hijackings and other terrorist activities.

40 Claims, 11 Drawing Sheets

ASSEMBLY

ASSEMBLY

COLLAPSULE VARIATIONS UTILIZING FREE SPACE

COLLAPSULE (5 STAGE) IMPACT DEFORMATION SEQUENCE

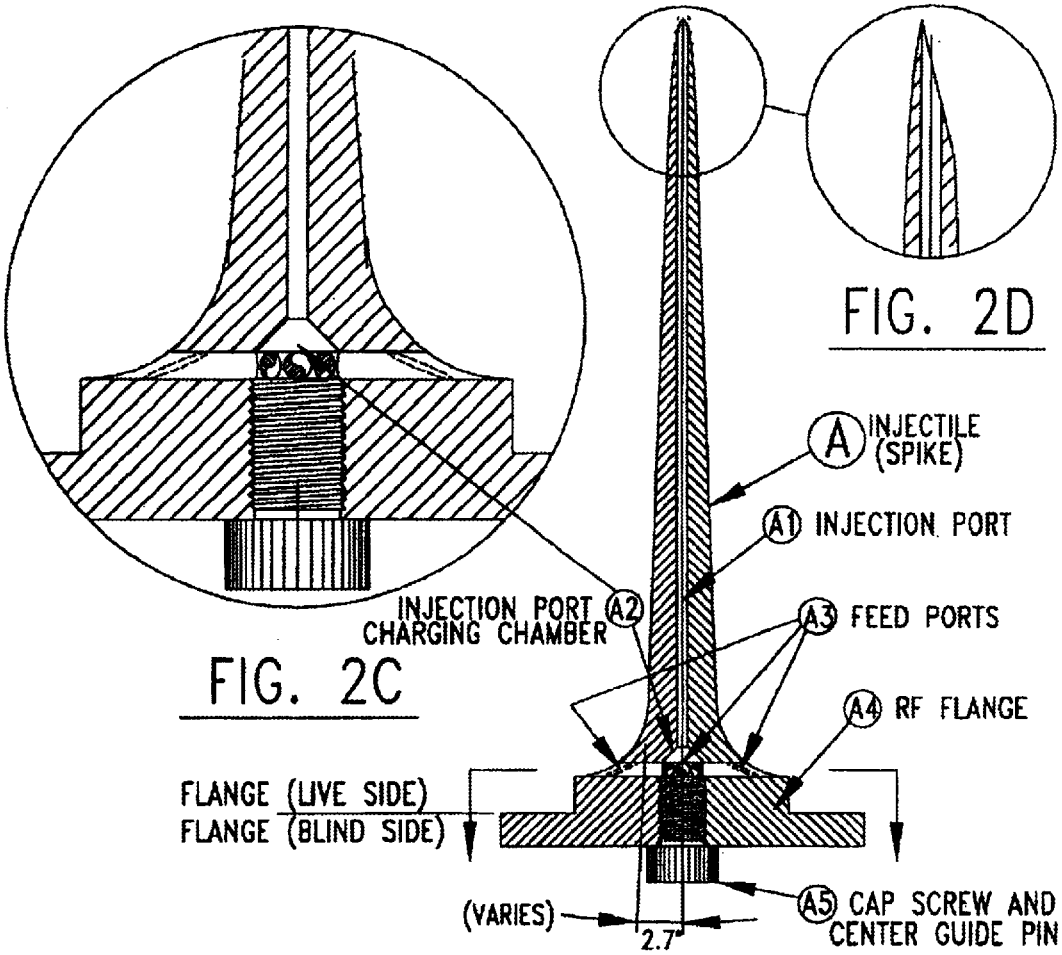
FIG. 2D
FIG. 2C
FIG. 2A
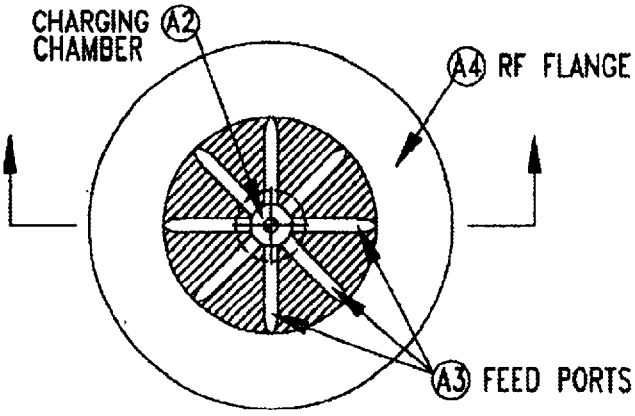
FIG. 2B

COLLAPSULE SHELL
TAPERED HEAD/TAPERED WALL

FIG. 6C2
FIG. 6C1
FIG. 6B2
FIG. 6B1
FIG. 6A2
FIG. 6A1
"FF"
"FF"
"RF"
"RF"
"RRF"
"RRF"
INJECTILE-FF
INJECTILE-RF
INJECTILE-RRF
TRANSITION LINE
A4
A3

COLLAPSULE SHELL TAPERED HEAD & WALL

A4 HALF BLIND FLANGE
A3 DISGHARGE PORTS
SECTION
FIG. 7B1
INJECTION PORT A1
INJECTION PORT CHARGING CHAMBER A2
FEED PORTS A3
RF FLANGE A4
B
B1
B2
B5
B4
B3
B8
B6
B7

PASSIVE ACTION SECURITY SYSTEMS

CROSS REFERENCE TO RELATED APPLICATIONS

The present application claims priority to U.S. Provisional Application Serial No. 60/362,472, filed on Mar. 6, 2002, which is now incorporated herein in its entirety by reference.

DESCRIPTION

BACKGROUND OF THE INVENTION

1. Field of the Invention

The present invention relates to the field of small arms ammunition and the like in general, and a specialty bullet adapted to deliver a tranquilizing fluid upon impact with its target, in particular.

2. Background Description

The tragic events of Sep. 11, 2001 in New York City, Washington, D.C. and elsewhere in the United States, have issued a wake up call to the free world. The circumstances leading to the terrorist takeover of commercial aircraft for the purpose of commandeering them to become "guided missiles" certainly reveals the extent to which civil disorder may be expected to continue for the foreseeable future. The bold presence of civil disorder is readily observable in both the public and private sectors, and bears witness daily to many blatant acts of lawlessness and terrorism. These unconscionable acts are unleashed upon the free world for any number of reasons, none of which can be justified or validated if they involve threatening harm to the innocent and unsuspecting general public. These activities represent major challenges to all those agencies charged with the ultimate responsibility for maintaining order.

The task now at hand is to prevent terrorists from killing themselves and taking as many as they can with them (leaving no witnesses). The time may also have come to challenge the "man-stopping power" of current standard ammunition and firearms-use philosophy. These "new wave" social problems will continue to grow within the world's population at a rate generally proportionate to the separation of the world's classes. The effects of uncertainty and fear will continue to threaten the many aspects of life we currently enjoy as free people in a free world. In particular, the threat of aircraft hijacking and other acts of terrorism, rebellion, lawlessness and war will call upon us to not just question the capabilities of conventional weapons and law enforcement techniques, but to re-evaluate them.

Because of the aforementioned issues, it is desirable to develop ammunition that will provide a much lower incidence rate of mishaps and fatalities resulting from bullet wounds in almost any given shooting situation. Characteristics of such an ammunition system should include reduced velocities and an intrinsic ability to produce much higher "hit survivability rates" over conventional ammunition. In addition, it is worth mentioning that the maiming and crippling effects of conventional ammunition would be drastically reduced as well.

Because of the aforementioned threats to public safety, law enforcement still needs to be provided with more options that are practicable and acceptable conclusive measures concerning public safety and requirements for commercial aircraft security systems. In particular, it is necessary to provide non-lethal solutions to security breach situations requiring the removal of a "public threat" from the private or public sector while maintaining the public safety as tantamount to the means of removal. It is easy to see the necessity or advantages of such a system in many situations that would call for the use of a firearm. This becomes obvious when there is a preference to capture the subject alive, as opposed to using deadly force. Of course, it is well recognized that it takes more than accuracy and luck to subdue a subject within a confined space such as an aircraft. This is but one example (albeit a most telling and ominous one) where the use of a revolutionary bullet system could have made a major difference in the events of the Sep. 11, 2001 tragedy. Although the destructive force of conventional firearm's ammunition on board commercial airliners "at altitude" could present as great a threat to the passengers and crew as that they were deployed to avert, even that option was not available. This is especially true, now that federal aviation officials are considering a return to use of the "air marshal" aboard commercial aircraft and/or providing aircraft pilots with firearms to maintain aircraft security. Although the "air marshal" or "armed pilot" will no doubt be well trained in the use of firearms, there still remains the threat that the firearm could be inadvertently misused. Even when properly used, the threat exists that conventional ammunition when discharged from the firearm could pass right through, or miss entirely, its intended target and thus strike an innocent bystander. In extreme cases, such ammunition could tear through the aircraft's fuselage, passenger seats and luggage or other critical aircraft components and thus endanger the lives of everyone involved. As such, there is an even greater need for the development of firearm ammunition that is capable of resolving a terrorist activity without the threat of causing even greater harm to surrounding passengers, crew, passersby and/or the infrastructure of the aircraft.

Presently, there is little that can match the raw effectiveness and man-stopping power of a conventional bullet as a deterrent in life-threatening situations. However, since conventional bullets do destroy life, tissue and bone structure, they also cause great collateral damage with the same effect (albeit unintentional) which can produce very undesirable results in certain circumstances. It is because of these circumstances and the "known capability of conventional bullets" that the law enforcement official becomes reluctant or unable to fire his weapon due to fear of killing the suspect and/or innocent bystanders. Even when the weapon is fired in such a situation using a conventional bullet the situation itself often produces a limited opportunity for the weapon to be precisely aimed. Under such circumstances "there is no guarantee but only a probability" for obtaining the desired result. Therefore, there remains a need to develop ammunition that can subdue and/or immobilize the subject with a "hit" placed almost anywhere on the body that will produce positive results while eliminating or greatly reducing the risks associated with the use of conventional bullets.

Products resulting from the development of a higher standard such as those referred to above can be expected to produce superior results by providing law enforcement with less lethal yet extremely effective deterrents to life-threatening situations. These measures can make huge inroads and contributions to the "front line" agent, air marshal and policeman by affording them more options for gaining the advantage and controlling the situation at hand.

Other non-lethal devices and projectiles have been proposed and used previously in attempts to address the above-referenced issues. Such products include stun guns, tasers, and tranquilizer dart guns of various forms.

Stun guns are highly effective as personal defense devices and are capable of incapacitating an assailant in a hand-tohand situation. As such they are specialty weapons, with extremely limited range capabilities (typically an arm's length or less). When used properly within their effective range stun guns provide the upper hand to the user, but their limited range diminishes their effectiveness in many situations.

Tasers resemble a handgun in size and shape and have a maximum range of approximately 21 feet. Such weapons fire two darts, each of which must remain connected to the weapons cartridge by wire cables in order to transmit an electric charge and maintain the electric pulse required to incapacitate the recipient target. The darts and cables are contained in a single shot cartridge. Although, tasers are capable of penetrating through clothing they are only effective under the most ideal of circumstances. Tasers are not be very effective in crowded close quarters due to their wires and the necessity for both darts to strike and remain in contact with the recipient target.

Tranquilizer dart guns have proven themselves to be the hands-down favorite choice when there is a requirement to capture any type of wild or dangerous game. Such weapons are highly effective against any of the most dangerous of wild game planet earth has to offer. Regardless of the temperament or focus of the subject animal at the time it is shot, the results are consistent and very predictable. It is almost always within a matter of seconds that the subject animal becomes disoriented and its demeanor isolated and placid whereby the animal becomes possessed with the overwhelming desire to passively lay down and be dealt with according to the concerns of its captors. However, there are major drawbacks when attempting to deploy tranquilizer dart guns as an effective anti-terrorist or law enforcement tool mainly because they are extremely limited by their highly specialized delivery system requirements, which makes them unusually large, unwieldly and rarely available to participate in situations creating a demand for their being brought into action for immediate use.

In addition to the above, alternative ammunition types have also been proposed and patented, but each suffers from several significant disadvantages. In U.S. Pat. No. 3,584,582 to Muller (issued Jun. 15, 1971), a bullet cartridge is disclosed that includes a hypodermic needle designed to penetrate the bullet body and deliver a hypodermic medium payload (i.e., tranquilizing fluid) to the intended target. Only one embodiment of the Muller disclosure (the third embodiment) actually places the hypodermic medium in the forward portion of the bullet's nose cavity. In that embodiment, the hypodermic needle includes a perforated needle plate that in turn is rigidly seated against a solid portion of the bullet (see FIGS. 6–8 of Muller). However, the Muller invention suffers the distinct disadvantage of a lack of integrity of the seated parts because the bullet's inherent design anticipates major deformation of the very same material, in the very same area, where the parts are seated. That is, the perforated needle plate would tend to separate from the solid portion of the bullet due to: (1) the buildup of fluid pressure as the tranquilizing fluid is delivered through the hypodermic needle, and (2) the major deformations anticipated in the seat of the needle plate.

Another type of ammunition system for delivery of a tranquilizing fluid through a hypodermic needle encased inside a bullet is disclosed in U.S. Pat. No. 3,502,025 to Payne (issued Mar. 24, 1970). The invention disclosed in Payne reveals that the tranquilizing fluid is stored in the rear portion of the bullet (see FIGS. 1–2 of Payne) while the hypodermic needle is imbedded into the bullet material in the forward portion of the bullet. As such, Payne's invention is limited in its effectiveness because the bullet material must be ductile enough to dissipate the full energy of the bullet's impact, yet strong enough to support the needle in place while the tranquilizing fluid is forced from the rear of the bullet through the tip of the needle located at the tip of the bullet's nose. It will be recognized that it is technically and practically unlikely that a bullet possessing the ballistic properties of a conventional round of ammunition, according to the Payne disclosure, can achieve the stated design goals without causing significant harm to the target (i.e., without tearing a hole through the target, thus defeating the purpose of the ammunition in the first place).

Based on the above issues, there still remains a need for a specialty bullet that can be fired from conventional firearms and that can deliver a tranquilizing fluid upon impact with a target in a manner that will disable and pacify the target without causing great harm to the target or to innocent bystanders or the surrounding area.

SUMMARY OF THE INVENTION

Based on the foregoing background, the purpose and intent of the bullet of the present invention is to render a threatening body unconscious or incapable of proceeding by way of direct injection of a drug (e.g. sodium pentothal, etc.). Whereby, the injected subject is overcome and given cause to be pacified, incapacitated and rendered unconscious, without causing great harm to the target, or surrounding area. Essentially, this invention is directed to a specialty bullet that is designed to transmit a tranquilizing fluid upon impact with a target for purposes of immobilizing the intended target. In a preferred embodiment, the specialty bullet is sized and shaped like that of a conventional bullet so that the specialty bullet can be used with conventional firearms. However, the disclosed invention is not limited to such a size and shape, and the concept described herein could work with innumerable types of ammunition. Based on the following description, it can be readily seen that such an invention can provide law enforcement officials with a non-lethal (or less than lethal) deterrent to life-threatening situations, including aircraft hijackings and other terrorist or unlawful activities. This concept is depicted schematically in the enclosed drawings.

The disclosed invention includes a so-called "collapsule" bullet, which is a molded, hollow cavity that is filled with a tranquilizing fluid. Preferably, the "collapsule" is fabricated using a high-strength malleable plastic polymer. The bullet is fitted with a so-called "injectile," which is a hypodermic injection spike (to transmit the tranquilizing fluid) that is backed and driven by an inertia base mass (i.e., lead core) located at the base of the bullet. Note that the term "collapsule™" is a derivative of the terms "collapse" and "capsule," while the term "injectile™" is a derivative of the terms "injection" and "projectile." In addition to those terms and addressing the function of the dynamic inertia base to shed mass in the form of a liquid and/or a secondary means of incapacitation the applicant also seeks recognition of the term "Fluid Activated Repulsive Trauma™" (F.A.R.T.™). The applicant is asserting intellectual property rights, including trademark protection, to those terms. Further, the applicant refers to this concept collectively as "Passive Action Security Systems™" (P.A.S.S.™), to which he also asserts trademark rights. Nevertheless, these terms do not place any limitations on the scope or breadth of the inventive concept or on the potential for applications of the invention outside the meaning of those terms.

The unique predictable characteristics of the specialty bullet casing to collapse into the form of a flange or mushroom upon impact creates a tendency for the bullet's energy to be distributed radially and uniformly to the targeted body. Due to this radial and uniform distribution of energy, and the bullet's having, "collapsed" and delivered a high-speed injection of its payload into the recipient, the spent "bullet" simply lacks sufficient energy to penetrate further. Also, by not having destroyed body tissue, as would a conventional bullet, the nerves within and surrounding the point of impact are free to feel the blow, and associated pain, sufficient enough to contribute heavily to shock-trauma disorientation and distraction.

The aforementioned "shock-trauma" will also make a very strong and positive contribution towards speeding the injected drug into effect, due to the expected heart rate increase experienced by the target after having learned one has just been shot. Therefore, a "hit" placed almost anywhere on a recipient body will produce a sudden halt to the evil plans and objectives contained therein but the body itself is merely put to sleep. Also in situations where one must "shoot first and ask questions later," there will be an opportunity to get answers "later." Depending upon the drug or tranquilizer used and the degree of potency desired, the reaction time for the subject to be overcome would vary but should compete within the range of expectations for conventional ammunition.

Advantages provided by the inventive concept disclosed herein over that of conventional ammunition include a wider range of shooting situations that would otherwise prohibit one from taking the shot for fear of striking innocent bystanders. This is especially true of train and bus stations, malls, and airline terminals or on board aircraft "at altitude" yet these are the very place lawbreakers and terrorists seek as targets and/or shelter. Where conventional copper and lead bullets travel at "supersonic velocities" averaging between 1000 and 1600 fps and where the concept disclosed herein is, in embodiments, "sub-sonic" with an average velocity of 600 fps or less. Where also, the bullet casing of the present invention collapses into the form of a flange or mushroom or other deformable shape upon impact. Further, where the "sub-sonic" bullet's energy is distributed radially and uniformly over a larger area of the targeted body than conventional bullets. And furthermore, due to this radial and uniform distribution of energy, and the bullet having collapsed and "shed considerable mass" by means of its operation upon impact, the spent "bullet" simply lacks sufficient energy to penetrate further. It is with consideration of these facts that make the spent bullet of the present invention is "highly unlikely" to have remaining energy sufficient enough to penetrate through an aircraft's fuselage, passenger seats, luggage or other critical aircraft components". With further observation, it becomes apparent that the disclosed invention will provide significant reductions in mortality rates and the crippling/maiming effects already attributed to conventional bullets. By further comparison, is the fact that a "hit" placed almost anywhere on a recipient body will still deliver the tranquilizing fluid with the same virtual effect (albeit temporary) as a mortal blow delivered by a conventional bullet. Moreover, through use of the injectile or spike as disclosed herein, there is also a likelihood that the disclosed invention could be effectively deployed against a bulletproof vest and/or other types of body armor with greater effects than conventional bullets.

BRIEF DESCRIPTION OF THE DRAWINGS

The foregoing and other objects, aspects and advantages will be better understood from the following detailed description of the preferred embodiments of the invention with reference to the drawings, in which:

FIGS. 2A–D depict the injectile component in accordance with an embodiment of the present invention including an enlarged view of the injection port charging chamber and the multiple feed ports through which the pressurized tranquilizer fluid is forced upon the bullet's impact with its target;

DETAILED DESCRIPTION OF THE PREFERRED EMBODIMENTS OF THE INVENTION

Figures 1A, 1B, 1C:
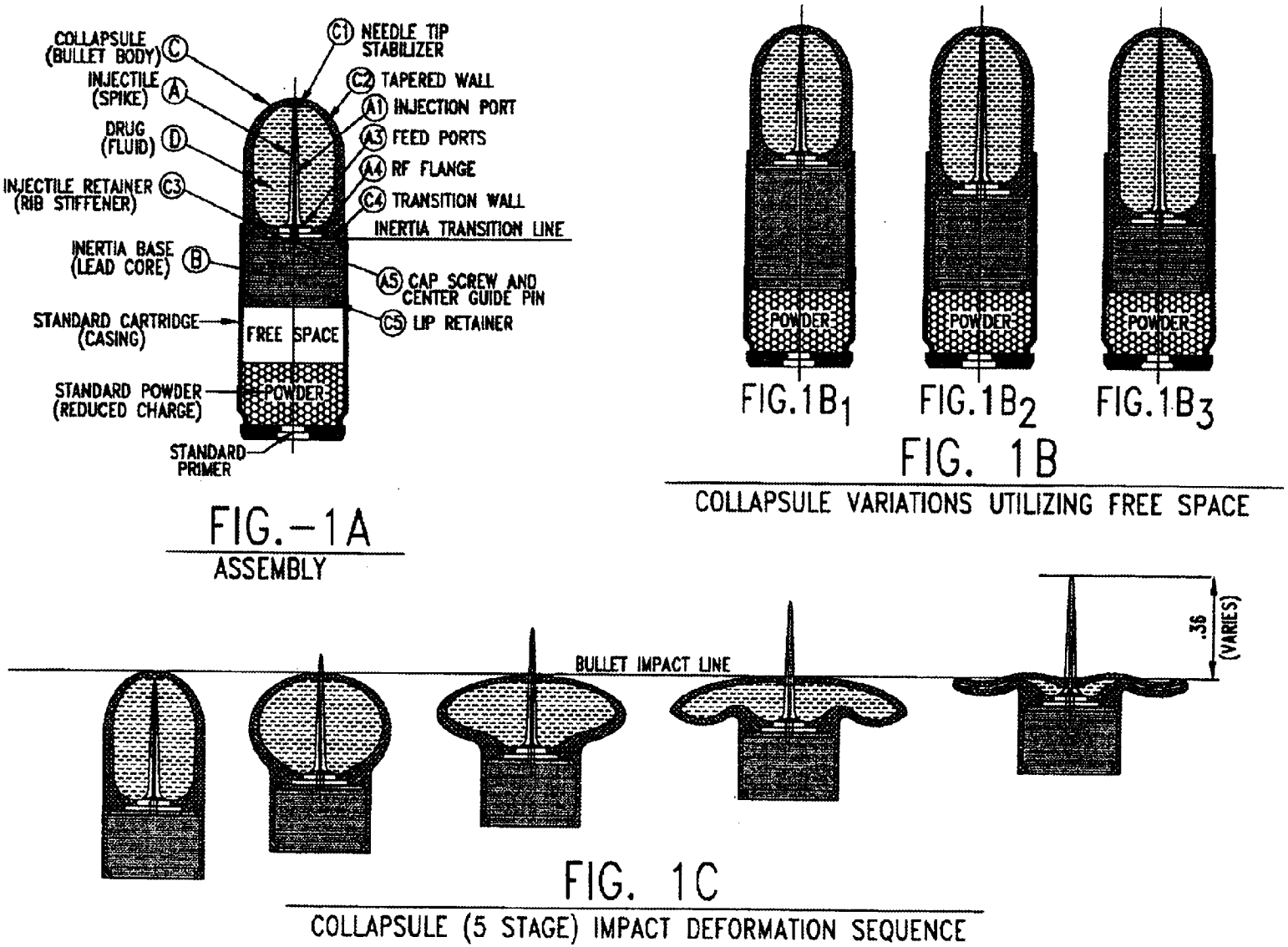
FIG. 1A depicts a schematic of the specialty bullet in accordance with an embodiment of the present invention, including a collapsule (bullet body), an injectile (hypodermic spike), an inertia base (lead core), drug (tranquilizer fluid), and a standard cartridge, primer and propellant powder.
FIG. 1B depicts several variations of the collapsule and inertia base combination bullet in accordance with an embodiment of the present invention presenting different amounts of tranquilizer fluid that vary inversely proportionally with the magnitude of the inertia base mass.
FIG. 1C contains a schematic depiction of five stages of the impact deformation of a collapsule in accordance with an embodiment of the present invention.
Figure 1D:
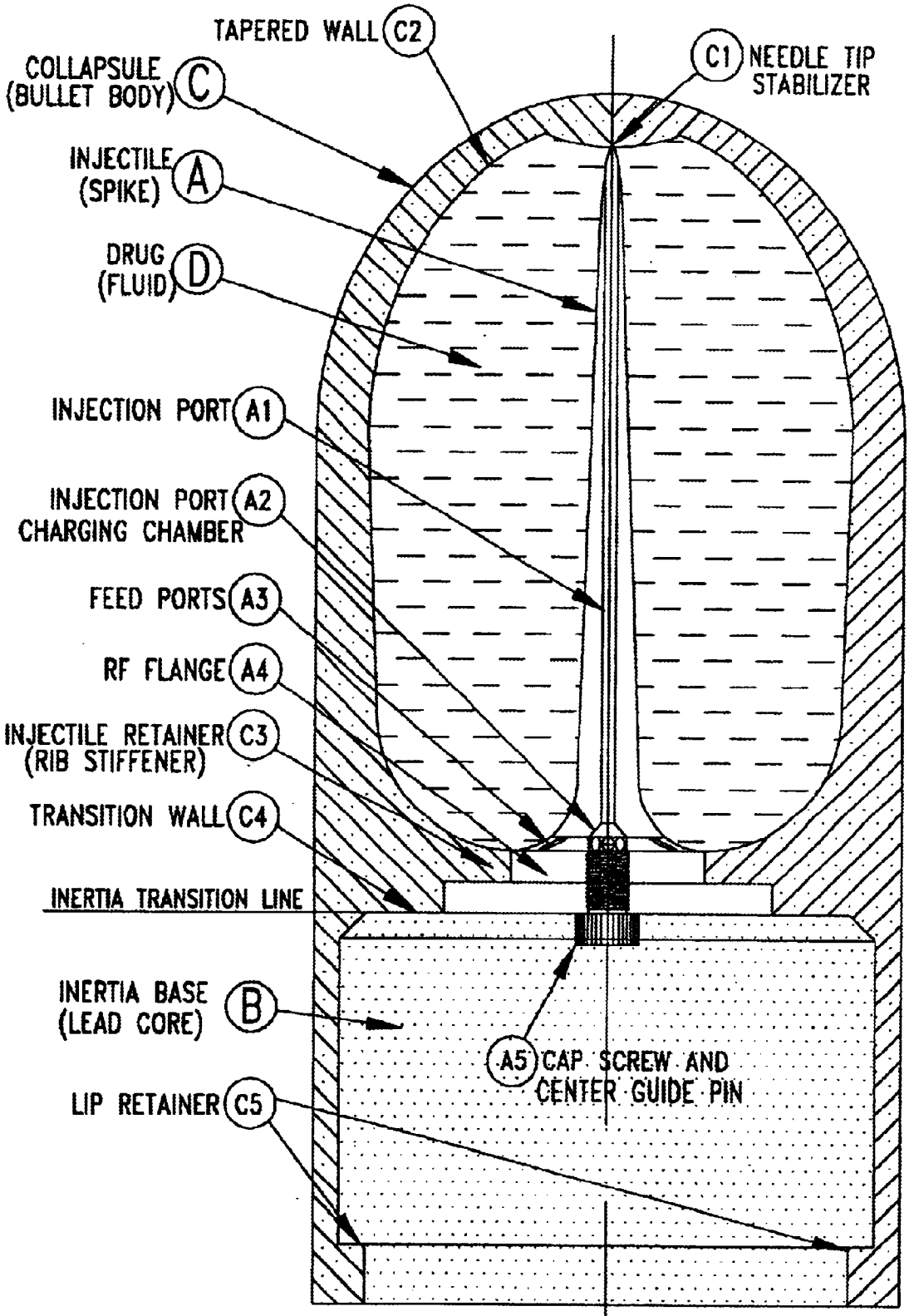
FIG. 1D contains a blow up of the schematic of the specialty bullet of FIG. 1A in accordance with an embodiment of the present invention.

Referring now to the drawings, and more particularly to the schematic in FIG. 1A, this concept is seen to include the collapsule bullet body (C), which encompasses the tranquilizer fluid (D) and the inertia base mass (B), and the "injectile," which is the hypodermic spike (A). This portion of the diagram is further depicted in the blowup of FIG. 1D. The collapsule bullet body (C) is constructed with the exterior shape and form of a standard commercially available bullet. Thus, it can be loaded into a conventional standard cartridge (casing), using known standard primers and powders for purposes of detonation and delivery when discharged from a standard commercially available firearm. Because of its design, the collapsule bullet does not require the delivery of a mortal blow to the target by hitting vital organs or by creating a "massive wound channel" to be effective, and it can be fired at much lower velocities than a conventional bullet (600 fps or less). Also, in shooting situations involving innocent bystanders and/or hostages where fatalities are to be avoided if at all possible, a high velocity, high-energy blow to the recipient may not be desirable. Instead, the specialty bullet of the present invention can be delivered to the target at much lower velocities. Since it requires only sufficient energy to deliver its payload (i.e., the tranquilizing fluid) into the recipient body to be effective by way of penetration of the injectile, and not full penetration of the bullet casing itself.

Figure 3A:
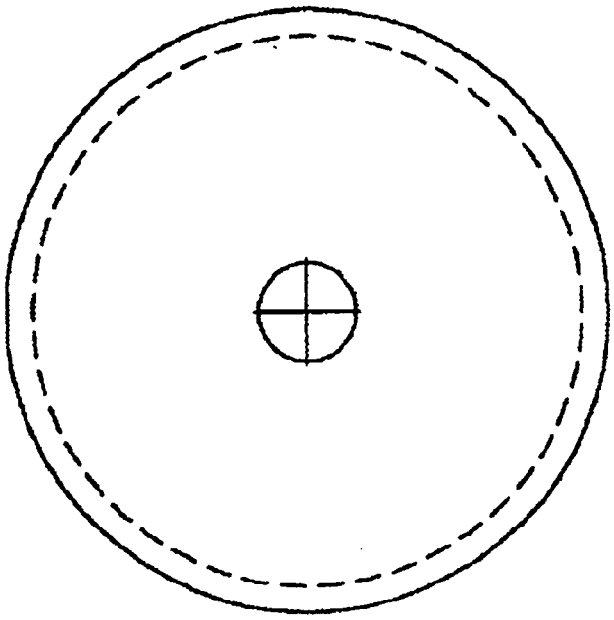
FIGS. 3 and 3A depicts the inertia base mass that can vary in size and magnitude in accordance with an embodiment of the present invention.
Figure 3:
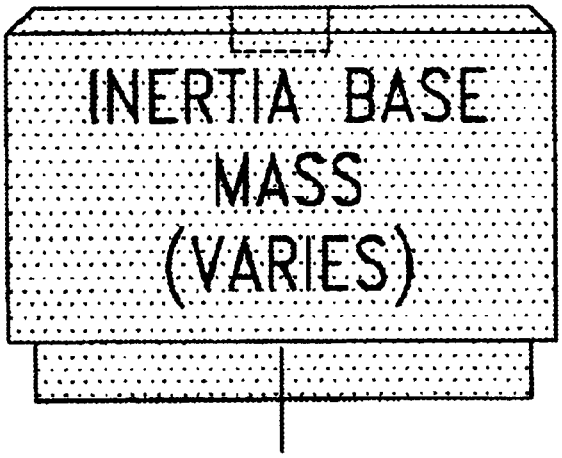

The inertia base (B) of the bullet is located in a cavity (C5) beneath the base of the injectile (A), that is, the inertia base cavity is preferably hollow and filled with either a solid weighted material, such as lead or a combination of materials in the form of the molded inertia base cavity. A purpose for this base mass is to provide sufficient kinetic energy to the bullet projectile and to properly balance the bullet's center of gravity to prevent tumbling or wobbling of the bullet after it is fired. The inertial base (B) may also be used for the additional purposes of shedding stored mass in the form of a liquid for dispersing a "Fluid Activated Repulsive Trauma (FART)" substance that would assist in incapacitating or overcoming the subject with mace or some other repugnant but effective deterrent upon impact. FIG. 3 also depicts an embodiment of the inertia base mass in accordance with the present invention. Lead, of course, is not the only choice of material for the inertia base mass since the inertia base cavity is formed into the collapsule shell, which can be filled or fitted with any of a wide variety of inertia base materials such as aqueos or noxious liquid. Any unused space beneath the inertia base mass can remain empty (depicted as "free space" in FIG. 1C). This molded cavity with a separate filler design feature provides a "fine tuning" capability when opting for ideal sectional density properties concerning accuracy and stability of the projectile. Thus, a bullet with various velocities, stopping power and range can be created by varying the size, mass and functionality of the inertia base (B), the "free space," the amount of powder and/or the amount of tranquilizer or incapacitating fluids. These optimum performance considerations are anticipated to be desired and sought during product testing and may cover a spectrum of choices of mass density ranging from lead to styrofoam. See, for example, the various sized inertia base masses depicted in FIG. 1B (wherein the "free space" has been eliminated in favor of additional amounts of tranquilizer fluid). The objective, of course, is to find the perfect material-possessing properties that would serve to enhance overall performance of the invention device. This feature of the collapsule design allows for a very wide range of tunable properties to be employed during the testing and development of suitable loads that will optimize its ability to meet the inventor's claims to be non-lethal or certainly less lethal than a conventional bullet and still be very effective, if not more effective, as a man-stopper.

The injectile or hypodermic spike (A) is further depicted in the blown-up schematic of FIGS. 2A–D. As disclosed, the injectile is described as a tapered hypodermic injection spike (FIG. 2D), with multiple feed ports (A3) (FIGS. 2B and 2C) and a centrally located, longitudinal single port discharge (A1) designed to release the tranquilizer fluid into the target upon the bullet's impact with the target. Preferably, the injectile is constructed of steel or a high-strength plastic polymer that is flanged (A4) and tapered in shape. During assembly, the injectile is inserted through the transition wall opening (located near the base of the fluid chamber; see element (C4) from FIG. 1A) and into the (hollow cavity of the bullet head. In an embodiment of the invention, located at the base and centered on the injectile flange itself, is an "injection port charging chamber," (A2) that is easily identified by its close proximity to the "cap screw and center guide pin" (A5). The cap screw serves three purposes. First, the cap screw seals the injection port-charging chamber. Second, the cap screw maintains centerline axis alignments of the inertia base mass and the injectile. Third, the cap screw eliminates separation of the injectile from the inertia base mass by attaching the two components through the means of a "press fit." There are other means possible for such a purpose, i.e. a dowel rod or shear pin. The cap screw may include or be replaced by a valve, i.e., check valve or poppet valve, in order to allow material in the inertial base mass (B) to communicate with the injection port (A2) upon impact of the bullet, itself In embodiments, the base of the injectile is in turn backed or anchored by the inertia base mass, consisting of a measure of ballast/weight for the purpose of providing sufficient kinetic energy to complete the injection cycle upon impact. As depicted in FIG. 1A and described above, the inertia base mass (B) is located within the bullet's partitioned base cavity (C5), secured in place by the means described above, and held in place by the retainer lip located at the bottom of the bullet base cavity (C5).

Upon impact, the inertia base mass transfers its kinetic energy to the inertia transition line, causing the bullet wall to begin to collapse, and pressurizing the tranquilizer fluid. This is depicted in FIG. 1C and described in more detail as follows.

The injectile punctures the bullet's nose and enters the target, whereupon the pressurized fluid, seeking the path of least resistance, rushes through the multi-feed ports (A3) into the injection port charging chamber (A2) and ultimately releases through the discharge port (A1) entering the target's body. Fluid discharge is accomplished by way of the pressurized fluid, in accordance with fundamental fluid dynamics, accessing a series of charging ports that are located at or near the base of the injectile and are in open communication with the discharge or injection port of the "injectile." Fluid or liquids in the inertia base mass (B) may also be discharged through the discharge port (A1) based on the same above principles.

Referring now to FIGS. 2A–D and 4, the design is intended to position the weighted body of the inertia base mass (B) directly behind the blind side of the half-blind flange portion (A4) of the injectile (A). The "live side" of the flange has positioned around its raised face, multiple feed ports (A3), which are open to the fluid chamber (see element (D) in FIG. 1A). The flange (A4) of the injectile (A) rests firmly upon the inertia base (3), and is seated into and behind the partition wall rib stiffener (C3), separating the collapsule's lower inertia base part (B) from the upper syringe chamber (D), which is a hollow and compressible chamber that houses the tranquilizing fluid (D) and the injectile (A). Once the bullet impacts the target, assuming the inertia base mass is of sufficient quantity, the bullet's forward momentum imparts pressure upon the tranquilizing fluid, thereby impelling the fluid to access the multiple feed ports (A3) of the injectile. The multiple feed ports (A3) are positioned radially around the injectile flange (A4), and form a vortex chamber within the flange body called the "feed" or "injection" port charging chamber (A2), at the location coinciding with the intersection of their center convergence. Additionally, the pressurized feed port charging chamber (A2), being common to the discharge or injection port of the injectile and situated within the hollow bullet chamber, causes the anesthetic fluid to flow between the inertia base (B) and the target body upon impact of the bullet striking the target. As such, the injectile is forced forward to penetrate the collapsule wall and thereby enters the target. This is depicted in the five-stage impact deformation sequence of FIG. 1C.

FIG. 1C depicts in schematic form the unique shape of the collapsule bullet that occurs upon impact. Specifically, the bullet casing is designed to collapse into the form of a flange or "mushroom" upon impact, creating a tendency for the bullet's kinetic energy to be distributed radially and uniformly to the target's body. This uniform and radial distribution of energy, along with the energy transfer that occurs upon impact and delivery of the tranquilizer fluid simply lacks sufficient energy to penetrate further. This makes the device safer for use in confined spaces (e.g., aircraft compartments) where innocent bystanders may be hit. In addition, the collapsule bullet does not deliver a massive blow that might destroy body tissue (as would a conventional bullet). Instead, it contributes to "shock-trauma disorientation and distraction," making the target easier to stop or subdue. This "shock trauma" will also accelerate the effectiveness of the tranquilizer fluid due to the heart rate increase that occurs naturally after learning one has just been shot. The ultimate effect of this device will depend, of course, on the type of drug or tranquilizer used and the degree of potency desired.

It is the inventor's intent, and this should be evident by the specific design features of this invention, that the multi-chamber approach to the specialty bullet will be almost infinitely tuneable within a very broad range of variables. This can be seen from the various schematics of FIGS. 1B, 4 and 5A, 5B. Such variability is primarily due to each of the component parts being confined within the relative space that is held specific and required for the purpose of their intended function. The allocated area for each component may be adjusted (expanded or reduced) with the only limitation being that the total volume of the collapsule shell remains constant for a given bullet type. This can be accomplished by manipulating or relocating the ribbed partition wall, along the straight and/or tapered side wall of the collapsule's interior plastic skin, and separating their respective chambers by a ratio of volume to mass. Those parts can then be adjusted by the required volume of their displacement or by the sectional density of their respective masses. This relationship between chambers may be widely adjusted, by simple relocation of the partition wall within the plastic skin of the bullet as shown in FIGS. 1B and 5A, 5B.

The specialty bullet of the present invention has located at the base of its hollow nose cavity (also referred to as "syringe chamber") a partition wall, positioned at the juncture of the three component parts. The said partition wall shares a common transition line with the face of the "inertia base" (see FIG. 4). This is accomplished in a manner that provides for sufficient material to be in "direct contact" with the base of the injectile. It also shares a common line (with sufficient material) in "direct contact" with the flat face of the injectile flange.

Figures 4, 4A:
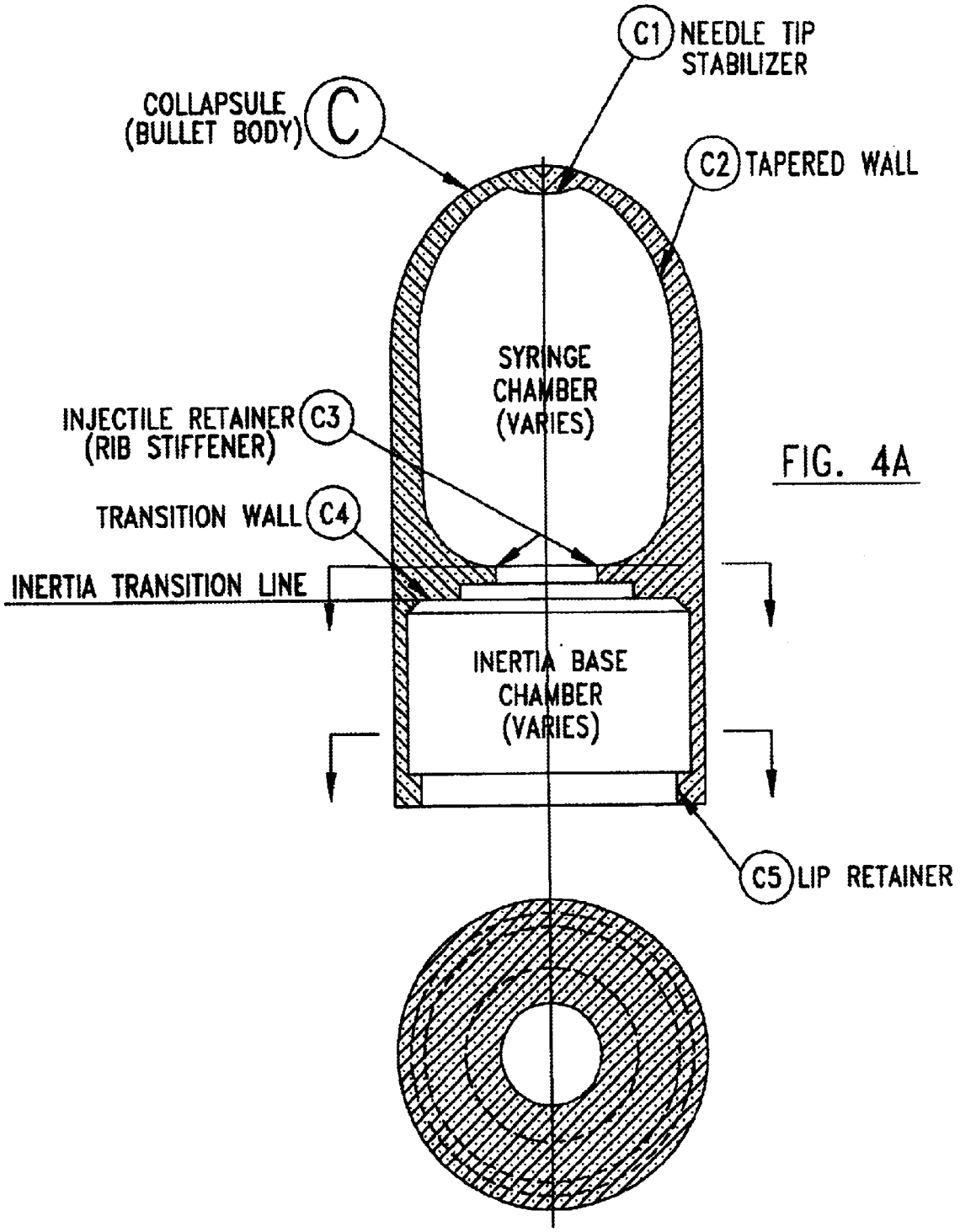
FIGS. 4 and 4A demonstrates the concept of a tapered head and tapered wall thickness for the collapsule in accordance with an embodiment of the present invention.
Figure 5B:
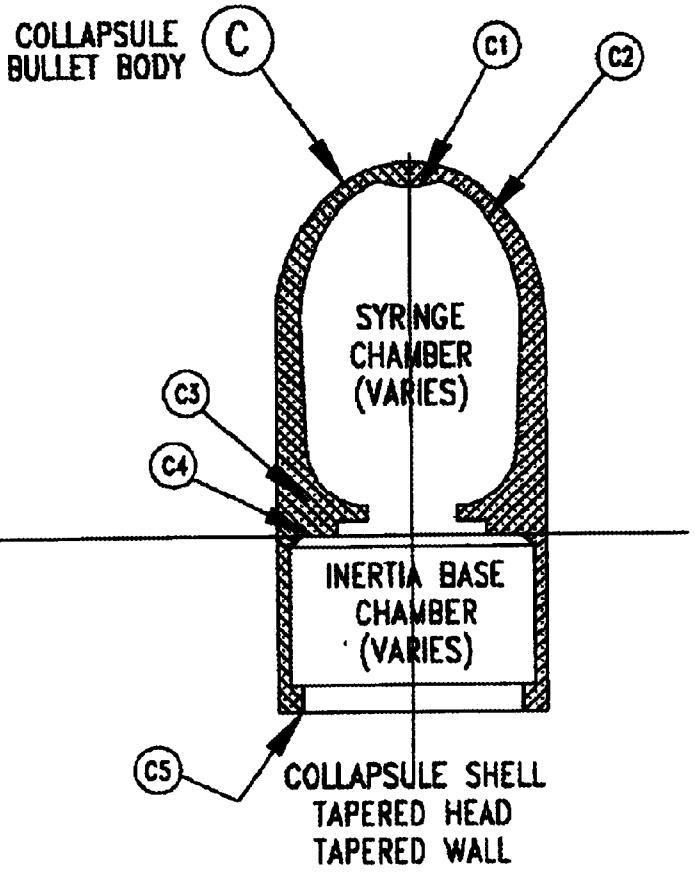
FIGS. 5A and 5B depict how the collapsule bullet can vary in accordance with an embodiment of the present invention to include use of a straight head/tapered wall and a tapered head/tapered wall.
Figure 5A:
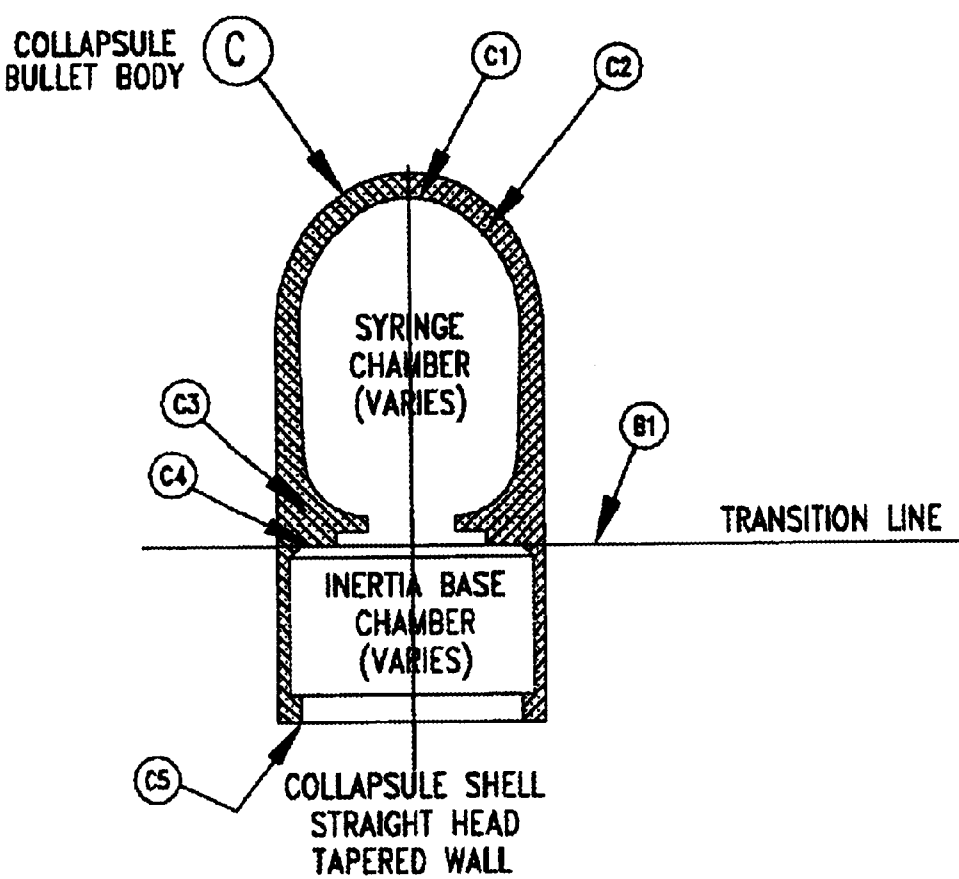

In addition, it must be noted, with continued reference to FIG. 4, that the design configuration of material used for the purposes stated above also serves a secondary function as rib or stiffener at the said juncture for the express purpose of preventing blowout or ballooning of the bullet wall where the dynamics of pressure, motion and deformation come to bear on the inherent ductility of the bullet material. As shown in FIG. 4, there is also a retaining lip or bead (C5) provided at the very base or foot of the bullet for the express purpose of preventing the inertia base mass from backing away from the line of commonalty.

It should be apparent to even the casual observer that my invention does not suffer from debilitating effects caused by fluid pressures and dynamics acting on seated parts. The pressure of the fluid remains on the fluid side of the injectile "flange" (i.e., above the "transition line" in FIG. 4), and the base of the injectile spike (see element (A) in FIG. 1D) remains in contact with the inertia base (B) with no forces acting to separate them. The expected deformation of the ductile material has been taken into consideration and appropriate allowances have been made and incorporated into the overall design. This is readily observable in my drawings, which clearly indicate there are no lifting effects acting upon my invention since the injectile has its multiple feed ports located on the same side (i.e., above the "transition line" in FIG. 4) as the "hollow nose chamber." Where the pressurized fluid seeks to gain direct access to the multiple feed ports, so does the pressure also apply itself to the exposed base of the injectile and the transition wall, forcing both tighter against the inertia base to maintain a very effective seal. Furthermore, since the seated parts are imbedded in considerable amounts of material in the juncture area where the dynamic forces of inertia and fluid pressure are expected to meet, there is no reason to expect the invention to do anything other than meet the design goals of the inventor in actual application.

FIGS. 5A and 5B depict how the collapsule bullet can vary in accordance with an embodiment of the present invention. In the embodiment of FIG. 5A, the collapsible bullet includes the use of a straight head/tapered wall. In the embodiment of FIG. 5B, the collapsible bullet includes the use of a tapered head/tapered wall.

Figures 6A, 6B, 6C:
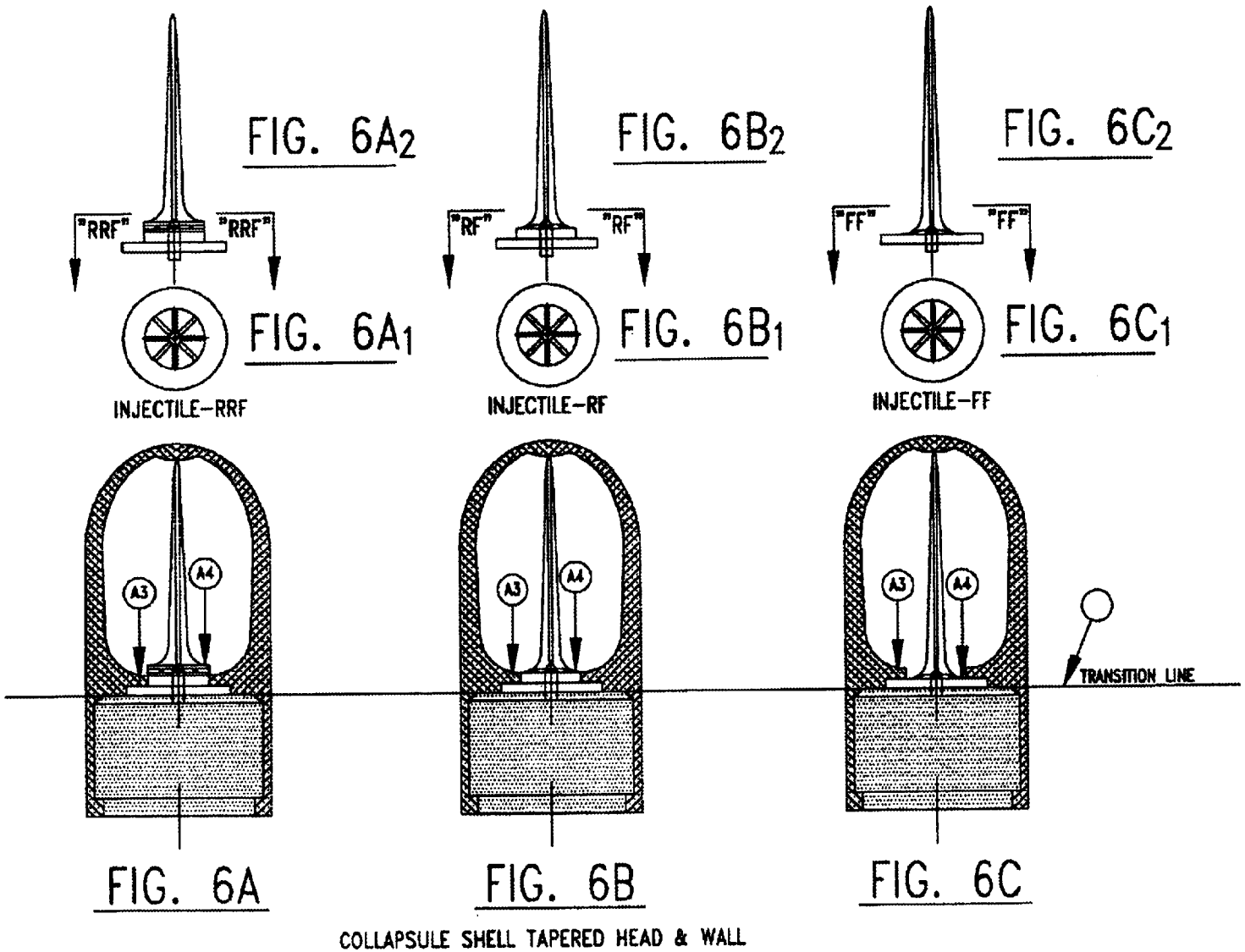
FIGS. 6A–6C depict variations of the flange attachment at the base of the injectile to the inertia base in accordance with embodiments of the present invention.

Finally, with reference to FIGS. 6A–6C, it can be seen that there are multiple possible arrangements for the attachment between the injectile spike (and its corresponding injectile feed ports) and the, top portion of the inertia base mass. Three such exemplary arrangements are depicted in FIGS. 6A–6C. In each arrangement, the shape and configuration of the flange (see element (A4) of FIG. 1D) and the partition wall rib stiffener (see element (C3) of FIG. 1D) are varied so as to provide different levels of structural stiffness and stability at the base of the injectile spike. For example, the embodiment of FIG. 6A show a flange portion (A4) with a high profile such that the flange portion (A4) extends above the partition wall rib stiffener (C3). In the embodiment of FIG. 6B, the flange portion (A4) is substantially at a same height as the the partition wall rib stiffener (C3) so as to form a smooth transition between the flange portion (A4) and the partition wall rib stiffener (C3). In FIG. 6C, the portion (A4) has a high profile such that the flange portion may be eliminated. In the embodiment of FIG. 6C, the base of the injectile spike remains seated behind the partition wall rib stiffener (C3) and sealed to the transition wall. Certainly, other configurations are possible and are included within the scope of the present disclosure.

Figure 7A:
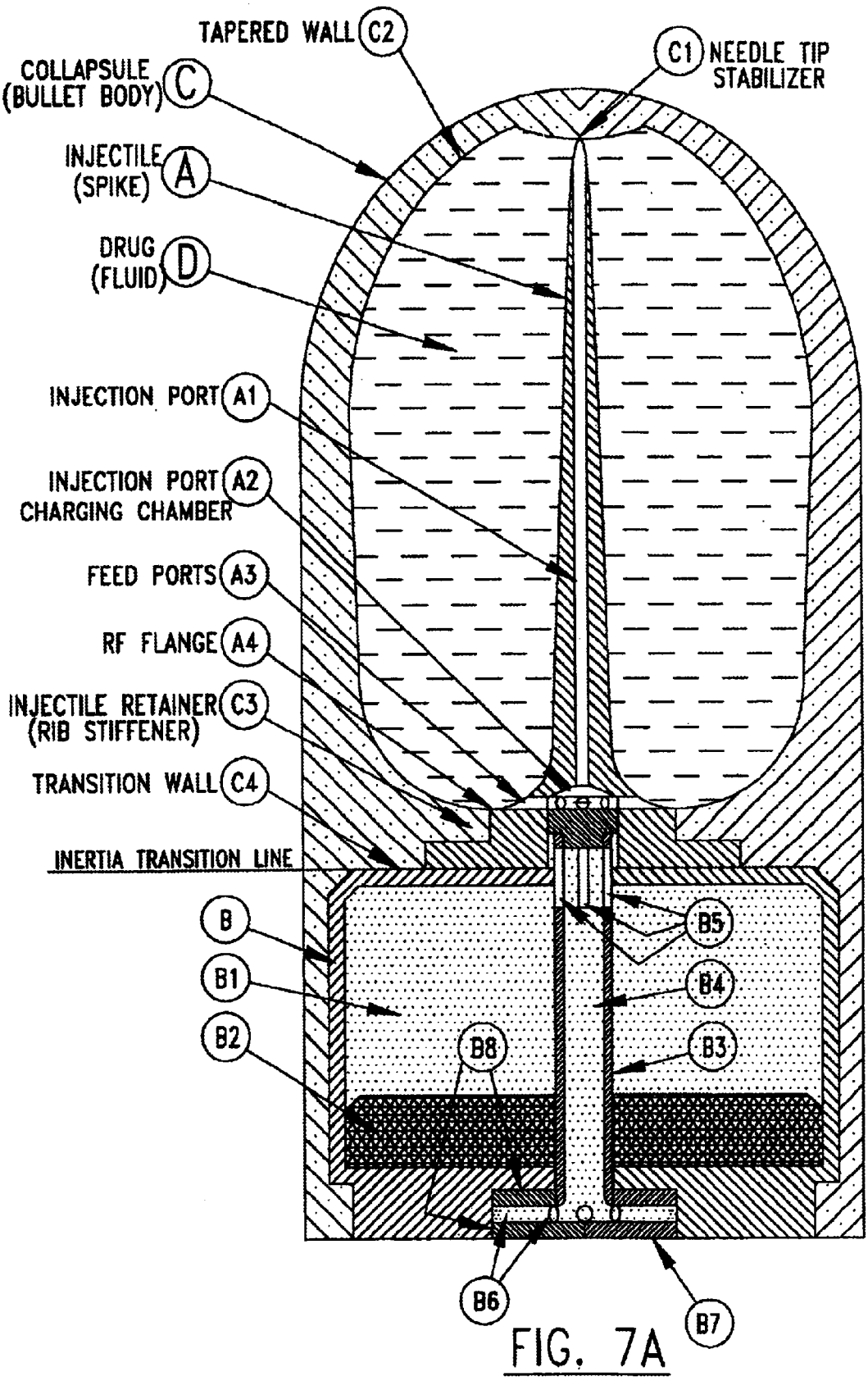
FIGS. 7A and 7B show an embodiment of the inertia base mass prior to and after impact, respectively, of the specialty bullet of the present invention.
Figure 7B:
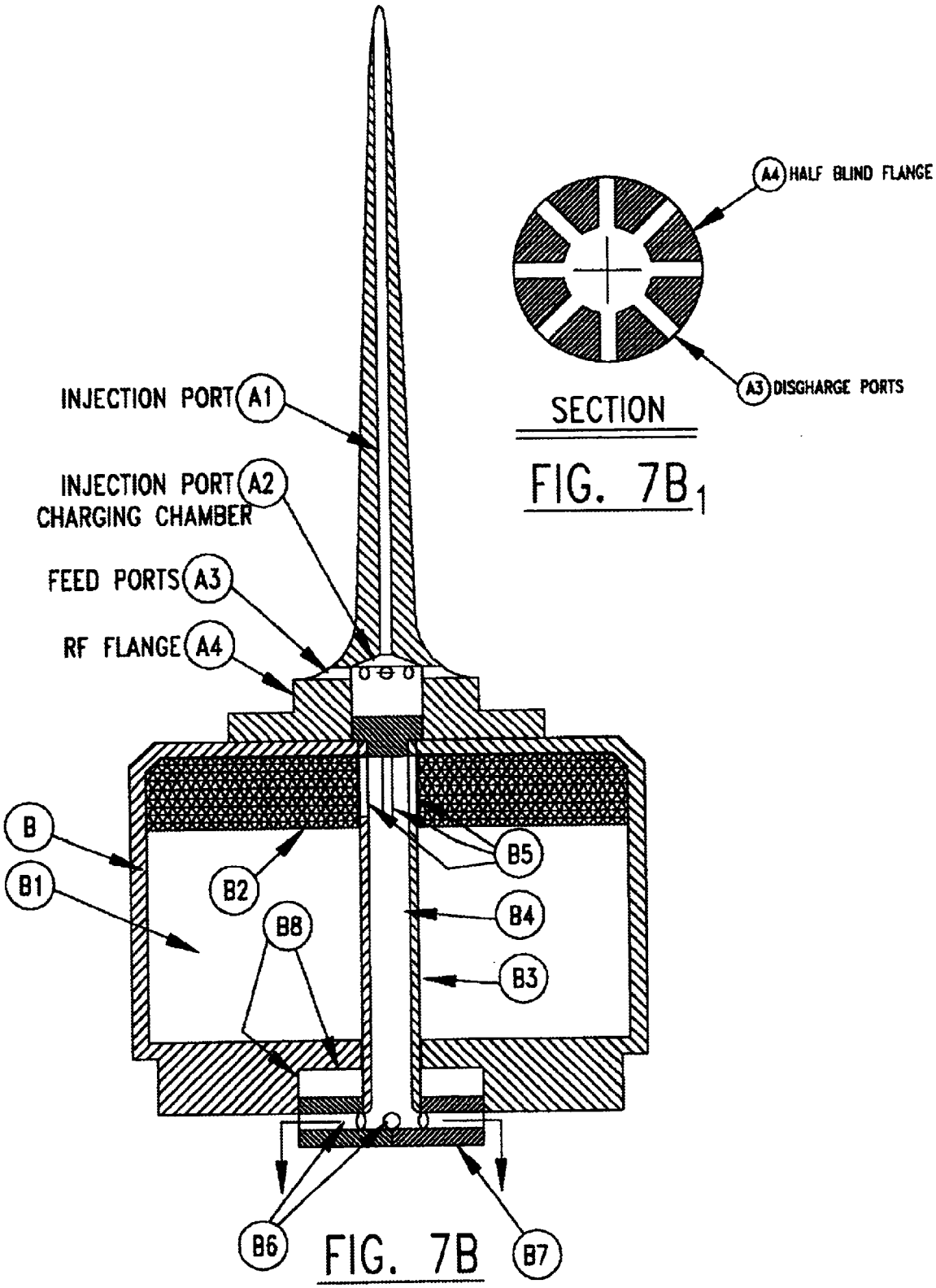

FIGS. 7A and 7B show an embodiment of the inertia base mass prior to and after impact, respectively, of the collapsule bullet of the present invention. In FIG. 7A, the inertia base mass (B) includes a cavity or chamber (B11) and a sliding mass (B2) slidable between a first position (FIG. 7A) and a second position (FIG. 7B). Still referring to FIG. 7A, a piston-like valve assembly (B3) is substantially centrally located within the inertia base mass cavity (B1) and extends, in an embodiment, into the base portion of the injectile spike (A). A top portion of the piston-like valve assembly (B3) is closed and is aligned with the injection port charging chamber (A2) of the injectile. The piston-like valve assembly (B3) includes a hollow valve stem (B4) with a plurality of slotted inlet ports (B5). In one exemplary embodiment, the hollow valve stem (B4) includes four slotted inlet ports (B5). The slotted inlet ports (B5) allow fluid within the cavity (B1) to pass into the hollow valve stem (B4) for discharge through radial spray nozzles (B6) located within and around a half-blind flange (B7) and positioned at the base of the hollow valve stem (B4). The half-blind flange (B7) is seated against a seat (B8) of the inertia base mass in order to prevent fluid from being discharged from the spray nozzle ports (B6) prior to impact and collapsing of the collapsule bullet body (C). FIG. 7B shows the sliding mass (B2) in the second, top position and the piston-like valve assembly (B3) in a release or discharge position.

In use, the cavity or chamber (B1) is filled with a fluid or gas (hereinafter referred to as a fluid). The fluid flows through the plurality of slotted ports (B5) and into the hollow valve stem (B4). The seated position of the half-blind flange (B7) prevents the fluid from discharging through the spray nozzle (B6). Upon impact of the collapsule (C), the collapsule bullet body collapses and forces fluid through feed ports (A3) and into the injection port charging chamber (A2) (as discussed above). Now, the pressurized fluid entering into the injection port charging chamber (A2) acts on the closed end of the piston-like valve assembly (B3) forcing the piston-like valve assembly (B3) downward into an open position and away from the injection port charging chamber (A2). In this position, the spray nozzles are exposed and fluid can then be discharged therethrough. Also, upon impact, the sliding mass (B2) slides between the first position (FIG. 7A) into the second position (FIG. 7B). This sliding action further forces the piston-like valve assembly (B3) downward, away from the injection port charging chamber (A2) into the open position. Also, this sliding action pressurizes the fluid within the cavity thus forcing the fluid through the spray nozzle (B6). In this manner, fluid can be discharged from the cavity (B3) upon impact of the collapsule bullet body (C).

Figure 7C:
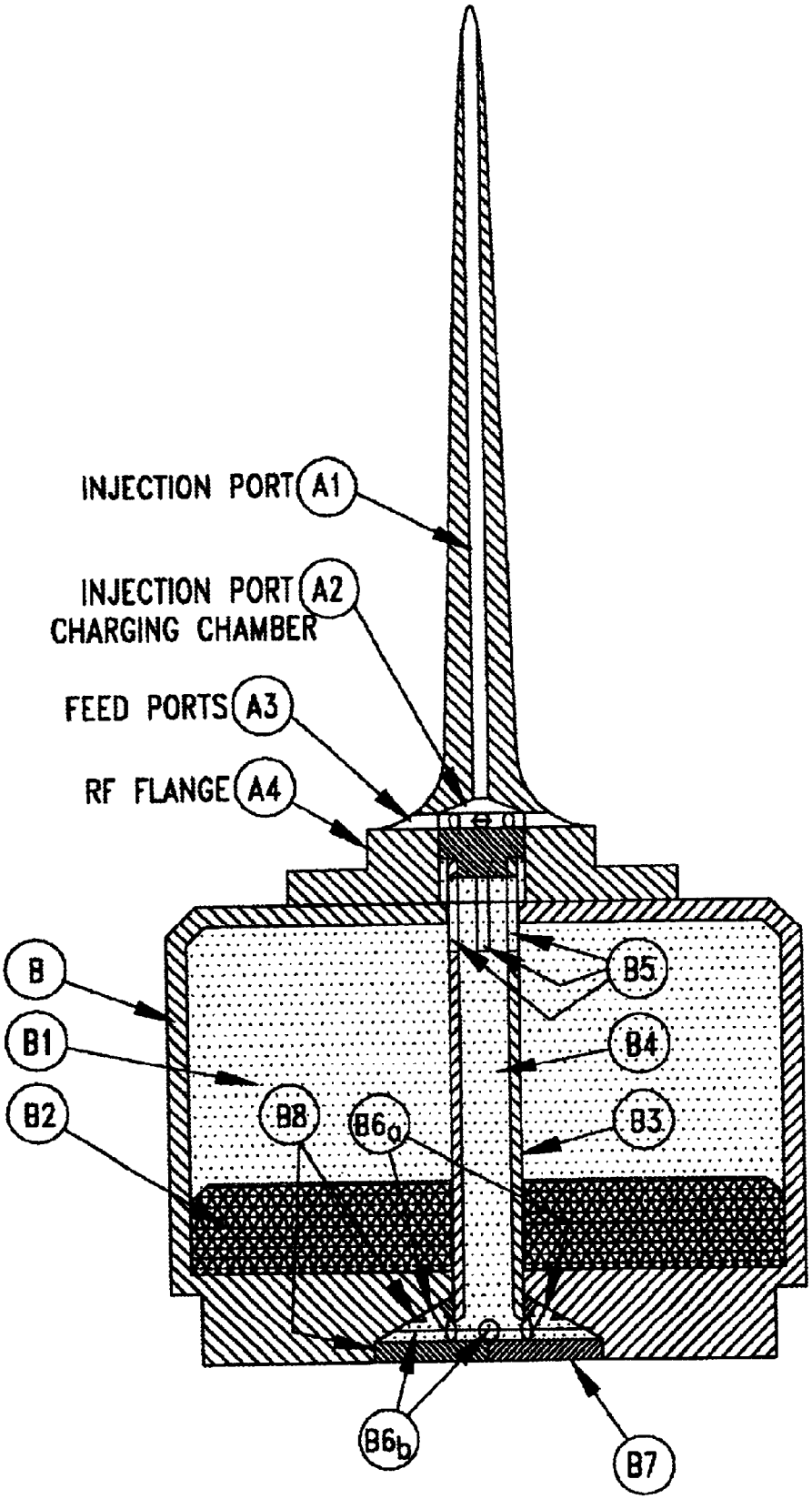
FIGS. 7C and 7D show another embodiment of the inertia base mass prior to and after impact, respectively, of the specialty bullet of the present invention.
Figure 7D:
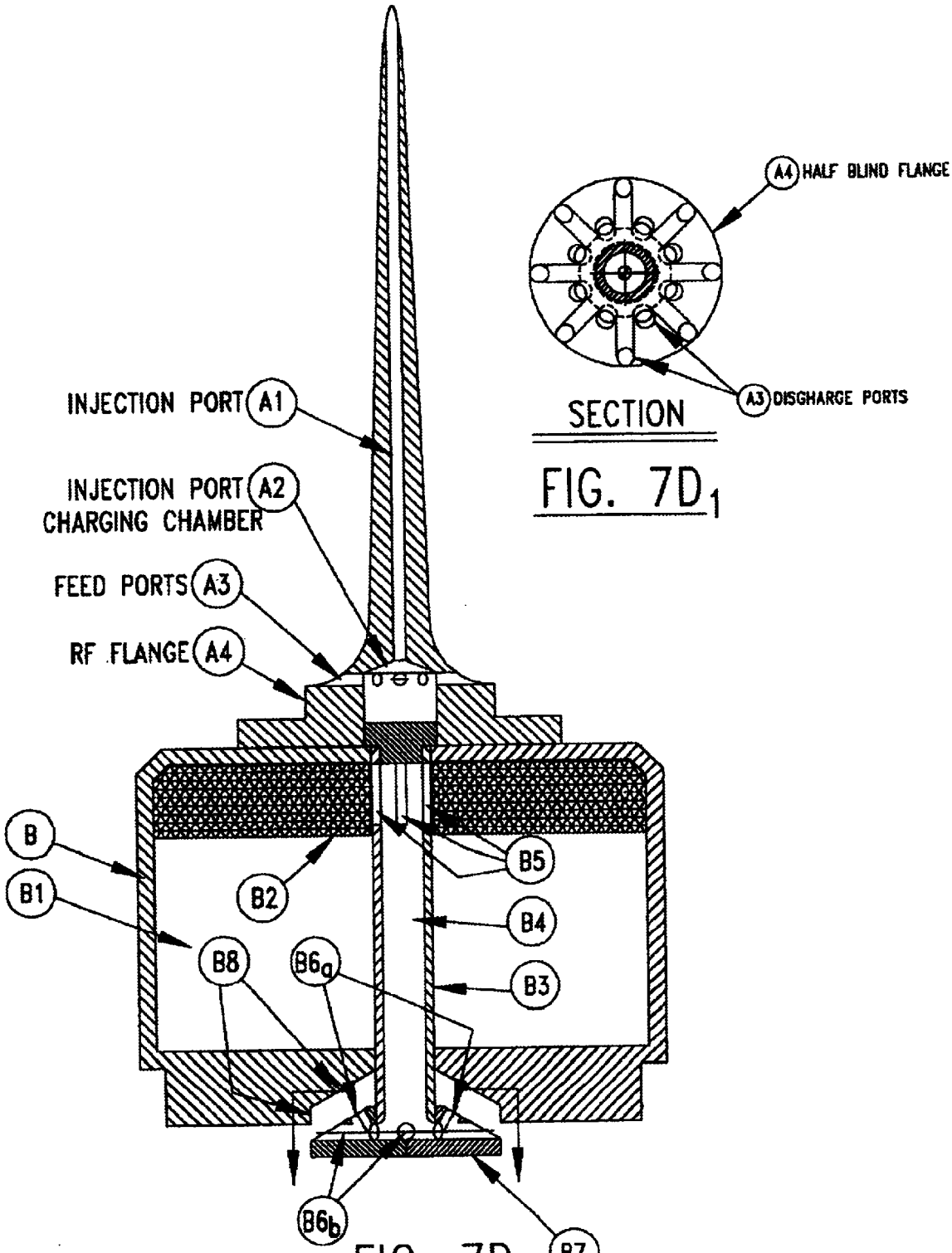

FIGS. 7C and 7D show another embodiment of the inertia base mass prior to and after impact, respectively, of the collapsule bullet of the present invention. In this embodiment, the half-blind flange (B7) is chamfered with upward extending spray nozzle ($B6_a$) and horizontally extending spray nozzles ($B6_b$). In addition to the features of the embodiment of FIGS. 7A and 7B, upon impact, the sliding mass (B2) forces the fluid in the cavity (B1) through the upward extending spay nozzle ports ($B6_a$) and horizontally extending spray nozzle ports ($B6_b$). The fluid discharged through the upward extending spray nozzle ports ($B6_a$) assists in unseating the half-blind flange (B7) from the seat (B8). That is, the fluid exiting from the upward extending spay nozzle ports ($B6_a$) strikes the underside of the inertia base mass thereby providing an additional force for moving the entire piston-like valve assembly (B3) into the open position.

While the invention has been described in terms of preferred embodiments, and specific embodiments by way of example in the drawings are described in detail, it should be understood that the drawings and detailed description thereto are not intended to limit the invention to the particular form disclosed. To the contrary, those skilled in the art will recognize that the present invention can be practiced with modifications, equivalents and alternatives within the spirit and scope of the above disclosure.

I claim:

1. A collapsible bullet, comprising:

a collapsible, hollow bullet body having an inwardly extending transition wall;

an injectile spike having a base, injection feed ports and a fluid discharge port in fluid communication with the injection feed ports via a chamber located within the base, the injection feed ports being positioned within the collapsible, hollow bullet body; and an inertia base mass located in a cavity beneath the base of the injectile spike, wherein the base of the injectile spike is sealed between the transition wall and the inertia base mass.

2. The collapsible bullet of claim 1, wherein the base is a flanged portion.

3. The collapsible bullet of claim 2, further comprising a wall rib stiffener defining the transition wall and which separates the inertia base mass from a syringe chamber defined by a hollow portion of the collapsible, hollow bullet, a first section of the flanged portion rests on the inertia base mass and is seated into and behind the wall rib stiffener.

4. The collapsible bullet of claim 3, wherein the flanged portion is sealed between the inertia base mass and the wall rib stiffener.

5. The collapsible bullet of claim 3, wherein the wall rib stiffener is a predetermined thickness and location along a side wall of the collapsible, hollow bullet.

6. The collapsible bullet of claim 1, further comprising a wall rib stiffener preventing blowout or ballooning of a wall of the collapsible, hollow bullet where dynamics of pressure, motion and deformation bear on the collapsible, hollow bullet, wherein the base rests on the inertia base mass and is seated into an and behind the wall rib stiffenerer such that the injectile spike is prevented from separating from the inertia base mass.

7. The collapsible bullet of claim 1, wherein the the inertia base mass includes a cavity.

8. The collapsible bullet of claim 7, wherein the cavity is filled with one of a solid weighted material and a liquid.

9. The collapsible bullet of claim 1, further comprising in combination with:

a cartridge housing a portion of the collapsible, hollow bullet body and the inertia base mass; and a free space in the cartridge beneath the inertia base mass.

10. The collapsible bullet of claim 1, wherein the inertia base mass is of a predetermined weight and size and provides kinetic energy and balances a center gravity of the collapsible, hollow bullet body to prevent tumbling or wobbling thereof.

11. The collapsible bullet of claim 1, wherein the injection feed ports are arranged about the base.

12. The collapsible bullet of claim 11, wherein pressure of fluid within the collpasible, hollow body is only permitted on a fluid side of the base to prevent lifting effects acting upon the base.

13. The collapsible bullet of claim 12, wherein the pressurized fluid gains direct access to the multiple feed ports and applies pressure to an exposed portion of the base and the transition wall, forcing a seal against the inertia base mass.

14. The collapsible bullet of claim 1, further comprising a mechanism for maintaining a centerline axis alignment of the injectile spike with respect to the inertia base mass.

15. The collapsible bullet of claim 14, further comprising a cap screw which seals the fluid discharge port.

16. The collapsible bullet of claim 14, wherein the mechanism is a dowel rod or shear pin which prevents separation of the injectile spike from the inertia base mass by a press fit.

17. The collapsible bullet of claim 1, further comprising a valve in the inertia base mass, the valve permiting discharge of fluid or gas within a cavity of the inertial base mass.

18. The collapsible bullet of claim 1, wherein the collapsible, hollow bullet body includes a shoulder portion and the the inertia base mass includes a contacting lip portion for preventing separation between the inertia base mass and the collapsible, hollow bullet.

19. The collapsible bullet of claim 1, wherein the collapsible, hollow bullet body is collapsible into a mushroom shape such that kinetic energy of the collapsible, hollow bullet body is distributed radially and uniformly.

20. A collapsible bullet, comprising:

a collapsible, hollow bullet body having a fluid chamber for holding fluid and an inwardly extending wall rib stiffener;

an inertia base mass located in a cavity of the collapsible, hollow bullet body; and an injectile spike positioned within the fluid chamber, the injectile spike having a base, injection feed ports and a fluid discharge port in fluid communication with the injection feed ports via a chamber in the base, a portion of the base being seated into and behind the the wall rib stiffener creating a seal between the inertia base mass and the wall rib stiffener, wherein fluid in the fluid chamber, upon impact of the collapsible, hollow bullet body, acts on an exposed portion of the base to force a seal against the inertia base mass and prevents the injectile spike from lifting from the inertia base mass.

21. The collapsible bullet of claim 20, further comprising a transition wall between the wall rib stiffener and the inertia base mass, the base being a flange portion such that a seal forms between the flange portion, the inertia base mass and the transistion wall of the rib stiffener.

22. The collapsible bullet of claim 20, wherein the wall rib stiffener prevents blowout or ballooning of a wall of the collapsible, hollow bullet where dynamics of pressure, motion and deformation bear on the collapsible, hollow bullet.

23. The collapsible bullet of claim 20, wherein the inertia base mass includes a cavity fitted with a static mass of material or a dynamic system of suitable mass, wherein the dynamic system forces fluid or gas from the inertia base cavity as a secondary means of incapacitation.

24. The collapsible bullet of claim 20, wherein the inertia base mass is of a predetermined weight and size and provides kinetic energy and balances a center of gravity to prevent tumbling or wobbling of the collapsible, hollow bullet body.

25. The collapsible bullet of claim 20, further comprising one of a cap screw, a dowel rod and shear pin, all of which prevent separation of the injectile spike from the inertia base mass.

26. The collapsible bullet of claim 20, further comprising a valve piston located at the base of the injectile spike for allowing fluid communication between an injection port charging chamber of the injectile spike and the valve piston.

27. The collapsible bullet of claim 20, wherein the collapsible, hollow bullet body includes a shoulder portion and the the inertia base mass includes a contacting lip portion for preventing the inertia base mass from separating from the collapsible, hollow bullet.

28. A collapsible bullet, comprising:

a collapsible, hollow bullet body having a fluid chamber and an inwardly extending wall rib stiffener and transition wall;

an inertia base mass located below the fluid chamber;

an injectile spike positioned within the fluid chamber and above the inertia base mass, the injectile spike having a flange, injection feed ports and fluid discharge port in fluid communication with the injection feed ports via a chamber in the flange, the flange being sealed, upon pressurization of fluid within the fluid chamber upon impact of the collapsible, hollow bullet body, between the wall rib stiffener, and inertia base mass.

29. The collapsible bullet of claim 28, wherein the wall rib stiffener prevents blowout or ballooning of a wall of the collapsible, hollow bullet where dynamics of pressure, motion and deformation bear on the collapsible, hollow bullet.

30. The collapsible bullet of claim 29, wherein the inertia base mass is of a predetermined weight and size and provides kinetic energy and balances a center of gravity to prevent tumbling or wobbling of the collapsible, hollow bullet body.

31. The collapsible bullet of claim 29, further comprising a mechanism for maintaining a centerline axis alignment of the injectile spike with respect to the inertia base mass.

32. The collapsible bullet of claim 29, further comprising one of a cap screw, a dowel rod, a shear pin, and a piston, all of which are capable of preventing separation or misalignment of the injectile spike from the inertia base mass.

33. The collapsible bullet of claim 28, further comprising a valve having spray nozzle located in a bottom of the inertia base mass for allowing fluid communication between a cavity of the inertia base mass and the spray nozzle.

34. A collapsible bullet, comprising:

a collapsible, hollow bullet body;

an injectile spike having a base, an injection port charging chamber with injection feed ports and a fluid discharge port in fluid communication with the injection feed ports, the injection feed ports being positioned within the collapsible, hollow bullet body;

an inertia base mass located beneath the base of the injectile spike, the inertia base mass having a fluid chamber;

a moveable valve member positioned within the fluid chamber of the inertia base mass and aligning with the injection port charging chamber;

a sliding mass member sliding between a first position and a second position within the chamber of the inertia base mass; and spray discharge nozzles located on the moveable valve member in fluid communication with the fluid in the fluid chamber and remote from the injection port charging chamber.

35. The collapsible bullet of claim 34, wherein the moveable valve member includes a hollow stem portion and fluid ports for providing fluid communicaiton between the fluid chamber of the inertia base mass and the spray discharge nozzles.

36. The collapsible bullet of claim 34, wherein the spray discharge nozzles include horizontally positioned discharge nozzles and discharge nozzles facing the inertia base mass.

37. The collapsible bullet of claim 34, wherein the moveable valve member extends partially into the base of the injectle spike.

38. The collapsible bullet of claim 37, wherein a top portion of the moveable valve member is in fluid communication with the injection port charging chamber such that pressurized fluid in the injection port charging chamber acts on the top portion of the the moveable valve member to move the moveable valve member from a closed position to an open position exposing the spray discharge nozzles.

39. The collapsible bullet of claim 34, wherein the inertia base includes a seat for closing the spray discharge nozzles.

40. The collapsible bullet of claim 34, wherein the sliding mass pressurizes fluid within the chamber of the inertia base mass forcing the fluid through the spray discharge nozzles.

* * * * *

UNITED STATES PATENT AND TRADEMARK OFFICE

CERTIFICATE OF CORRECTION

PATENT NO. : 6,736,070 B2
DATED : May 18, 2004
INVENTOR(S) : Joseph C. Baltos

It is certified that error appears in the above-identified patent and that said Letters Patent is hereby corrected as shown below:

Column 12,
Line 25, delete “an and” and insert -- and --.

Signed and Sealed this

Thirteenth Day of July, 2004

JON W. DUDAS
*Acting Director of the United States Patent and Trademark Office*